United States Patent [19]

Landa

[11] 4,378,169

[45] Mar. 29, 1983

[54] RESILIENT BREECH FOR MICROBALLISTIC PRINTERS

[75] Inventor: Benzion Landa, Edmonton, Canada

[73] Assignee: Savin Corporation, Valhalla, N.Y.

[21] Appl. No.: 267,675

[22] Filed: May 27, 1981

[51] Int. Cl.[3] ..... B41J 3/02

[52] U.S. Cl. ..... 400/118; 124/41 C; 124/51 R; 124/56; 400/121

[58] Field of Search ..... 400/118, 121; 101/114; 124/41 R, 41 C, 56, 72, 51 R

[56] References Cited

U.S. PATENT DOCUMENTS 4,046,131 9/1977 Clark et al. ..... 124/41 R X

FOREIGN PATENT DOCUMENTS 2031163 1/1971 Fed. Rep. of Germany .... 124/41 R

*Primary Examiner*—Paul T. Sewell

*Attorney, Agent, or Firm*—Shenier & O'Connor

[57] ABSTRACT

A breech for the gun of a microballistic printer comprising a plurality of metal spheres positioned on the inside periphery of a cup, forming a central opening slightly smaller than the spherical projectiles used in the microballistic printer. The spheres are held in spaced relation by a projectile which is adapted to be sequentially replaced by another projectile during the operation of the microballistic printer. The spheres forming the central opening through which the projectiles pass are sealed with a sealing compound to prevent the loss of gaseous pressure which is built up behind the projectile and which propels it toward the printing surface.

5 Claims, 5 Drawing Figures

RESILIENT BREECH FOR MICROBALLISTIC PRINTERS

CROSS-REFERENCE TO RELATED APPLICATIONS

In my copending application, Ser. No. 39,372, filed May 15, 1979, I have disclosed a microballistic printer in which a gun having a muzzle and a breech is provided with means for aiming the gun in desired directions to propel a series of projectiles against a platen to produce printed characters such as letters, numerals, and the like. The breech disclosed in said application includes a sphincter or restriction made of a resilient plastic material and has a service life extending over millions of cycles of operation. The present application discloses a breech useful in guns, including a gun such as that disclosed in said copending application, which affords a service life far greater than that of the breech disclosed in said copending application.

BACKGROUND OF THE INVENTION

The background of the present invention, insofar as its use in the printing field is concerned, is provided by the disclosure in said copending application, Ser. No. 39,372, referred to above. The background presented by the microballistic printer of said copending application presents the need for a resilient breech having an extremely long service life under operation at cyclic rates which may range from 1,000 to 2,000 per second. In such microballistic printer, the projectiles are spheres or balls of metal which are presented successively to a breech having a passageway which includes a sphincter or restriction made of a resilient plastic material. Each successive projectile is brought to the breech under mechanical force, and gaseous pressure is built up in a chamber behind the projectile during the time required for the projectile to be mechanically forced through the restriction. After passing the restriction, the projectile is released into the gun barrel for travel and discharge under gaseous pressure. Incident to the forcing of each projectile through the breech restriction, the resilient material is subjected to some frictional wear and is distorted to permit the passage of the projectile therethrough. While the resilient materials from which such a breech may be made have afforded a service life of several hundred million discharges, it is desirable that a breech be provided that will have a much greater service life.

FIELD OF THE INVENTION

This invention lies in the field of printing by impact of successively propelled projectiles on a pressure- or impact-sensitive printing medium. Specifically, the invention lies in the field of breech devices for use in guns for such printing assemblies.

DESCRIPTION OF THE PRIOR ART

Applicant is not aware of any prior art which is specifically pertinent to the construction of the improved resilient breech disclosed herein. The resilient breech disclosed in said copending application, Ser. No. 39,372, includes a restriction or sphincter molded from a resilient material which will yield to permit passage of a projectile therethrough when such projectiles is subjected to a sufficient force. During the brief period in which a projectile is passing through the breech under such a force, the projectile and the breech restriction together form a gaseous seal whereby a gaseous pressure may be built up behind the projectile to propel the projectile through a gun barrel after it has been forced through the breech. In contrast with the breech disclosed in said copending application, the breech disclosed herein utilizes a resilient plastic material to perform the required sealing function only and utilizes metal elements to afford the required resiliency in the restriction and to take the wear incident to the forcing or projectiles through the breech.

SUMMARY OF THE INVENTION

The breech of the present invention is made up of a plurality of metal elements which form a restriction that will yield sufficiently and yet, within the elastic limits thereof, will permit the projectile to be forced through the breech when a predetermined force is applied. Inasmuch as the metal elements, in yielding to permit such passage, are not subjected to forces beyond their elastic limits, they will recover their original shape and dimensions immediately upon the passages of the projectile through the breech. The metallic elements of such breech are embedded in a resilient plastic material which serves to seal the interstices between the elements, thereby performing the function required in the specific microballistic printer in which the resilient breech of the present invention is disclosed. In the disclosed printer, the projectiles are spheres or balls which are successively brought up to the breech restriction by a mechanical device and, during the brief period in which each is being forced through the breech restriction, a gaseous pressure is built up behind the projectile. The gaseous pressure is insufficient to force the projectile out of the breech restriction. As the mechanical device continues to exert mechanical force, the projectile passes the restriction, momentarily exposing the breech bore to the gas pressure which propels the thus dislodged projectile down the bore of the printing gun to be discharged from its nozzle at a high speed. By this time, the succeeding projectile has been mechanically brought into the breech restriction for a repetition of the cycle.

In its simplest form, the present invention is embodied in a structure wherein six spherical bodies, conveniently consisting of six of the projectiles themselves, are arranged in a metallic cup, wherein they are squeezed together so as to define in the central area thereof a breech opening slightly less than the diameter of any one of the projectiles to be used therewith. The six spheres are jammed into this cup by the use of a suitable fixture, such as a mandrel, forcing them to assume a circular configuration in which they have reached a stressed equilibrium with the outer points of contact between the spheres and the inner wall of the cup distorted under radial pressure and with each sphere distorted at its point of contact with an adjacent sphere along the circle of contact between the six spheres.

In the microballistic printer to which this invention is specifically directed, the spheres are very tiny solid balls made of tungsten carbide, for example, which is an extremely hard and wear-resistant material. However, even tungsten carbide is resilient within limits, and it is capable of being distorted under stress without yielding, so long as the stress applied does not exceed the elastic limit of the material.

To provide a seal against gaseous pressure when the central sphere is being forced through the breech restriction, the surrounding spheres are embedded in a resilient plastic material. Such material fills all interstices between the surrounding spheres and is so molded as to define a passageway through which the projectile may be forced.

It will be apparent that the improved breech of the present invention performs the same operation as that of said copending application, Ser. No. 39,372. However, it presents the important distinction that the surfaces defining the restricted portion of the passageway include the embedded surrounding metal spheres which are substantially immune to frictional wear and which protect the adjacent surfaces of the embedding plastic material against frictional wear sufficient to permit gaseous leakage at the point of maximum restriction of the breech. Accordingly, the present invention provides a resilient breech in which the restriction remains almost unchanged as a result of the great resistance to wear of the metal spheres and the embedding plastic, which is protected from wear, continues to serve its function of the sealing against the gaseous pressure.

In a broader sense, the principles of the present invention may be embodied in a structure wherein a number of spheres, greater or less than the six spheres hereinabove referred to, may be arranged to define a circular passageway of a desired diameter. Furthermore, in certain uses of the principles of the present invention, gaseous sealing might not be required, in which event the embedding resilient plastic material may be omitted.

OBJECTS OF THE INVENTION

One object of my invention is to provide an improved breech for use in microballistic printers.

Another object of my invention is to provide a breech for a microballistic printer which is more resistant to wear than the breeches of the prior art.

Other and further objects of my invention will appear from the following description.

DESCRIPTION OF THE PREFERRED EMBODIMENT

Figure 1:
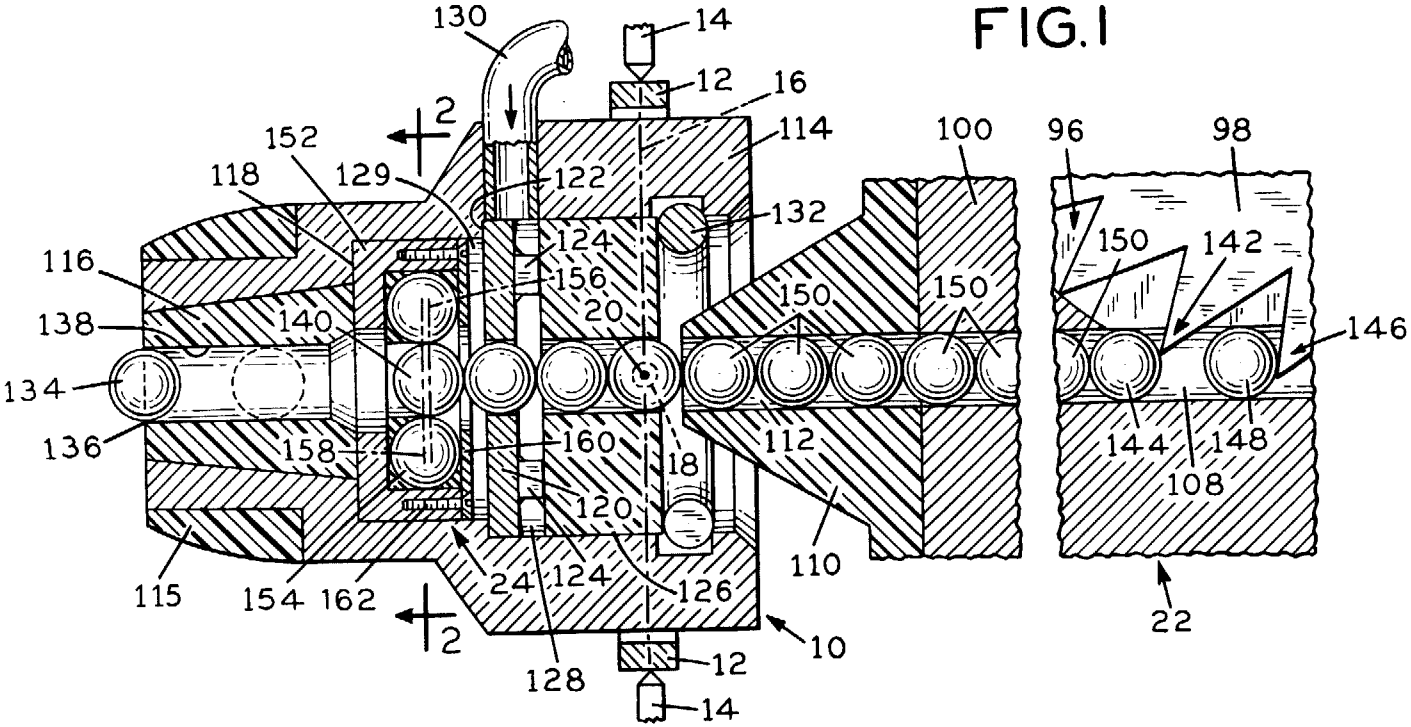
FIG. 1 is a fragmentary horizontal sectional view, drawn on an enlarged scale, showing the improved resilient breech of the present invention installed in a microballistic printer of the type viewed along the line 1—1 of FIG. 5.

In FIG. 1, there is shown a gun assembly 10 mounted for limited universal movement in a gimbal mounting including a gimbal ring 12 pivoted externally on pins 14 for movement about an axis 16 lying in a horizontal plane. The gimbal ring 12 is provided with internal pivot pins 18 (see FIG. 5) about which the gun assembly 10 is pivoted for movement about a vertical axis which intersects the horizontal axis 16 at right angles at a point 20 as is customary in gimbal mountings. External pivot pins 14 and the point 20 remain fixed with respect to a projectile supplying station indicated generally in FIG. 1 by the reference numeral 22, whereby the gun assembly 10 may move universally about point 20 and relative to the supplying station 22.

The improved resilient breech of the present invention is indicated generally by the reference numeral 24 in FIG. 1 and will be described in detail below.

The microballistic printer in which the present invention is illustratively disclosed herein is described in detail in my copending application, Ser. No. 39,372, and specific reference to that application is hereby made for all details which are not included in the following brief description of the microballistic printer.

Figure 5:
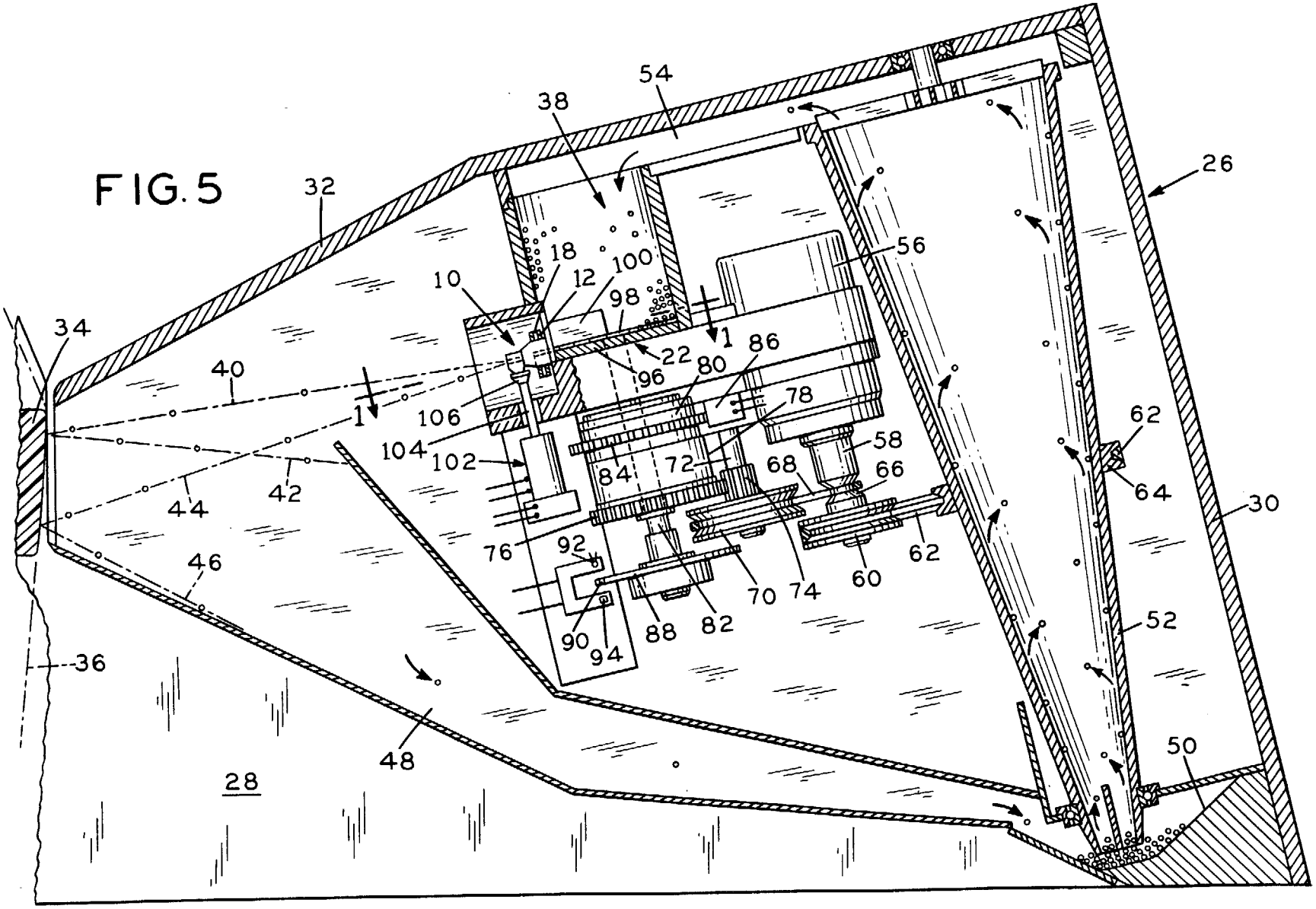
FIG. 5 is a fragmentary diagrammatic vertical sectional view of a microballistic printer, shown in my copending application, Ser. No. 39,372, in which the improved breech of the present invention may be used.

Referring now to FIG. 5, the projectile supplying station 22 is shown fixed within an enclosure 26 including a rear side wall 28, a front side wall (not shown), an end wall 30, and a top wall 32. The front and rear side walls extend to the left beyond the scope of FIG. 5 to support a paper and ribbon handling station (not shown) and a fixed platen 34 across which paper and carbon are moved for impact printing of desired characters with desired spacing. The path of the paper is indicated by the broken line 36 and for normal printing operations the paper will be moved upwardly stepwise for spacing between successive lines. While the paper may be impact sensitive, it also may be plain paper, in which event a transfer ribbon of carbon paper or inked fabric may be moved across the path of the paper in customary manner. It is a specific advantage of the microballistic printer that multiple copies may be made by interleaving two or more layers of paper with transfer ribbons for travel across the platen 34.

The projectiles used in the printer are preferably tiny spheres of metal. For example, they may be made of tungsten carbide, each having a diameter of 0.8 mm. As more fully described in my copending application, Ser. No. 39,372, the printer is provided with a very large number of such projectiles, which are supplied from a bin 38 by the projectile supplying station 22 to be fired in bursts of predetermined number from the gun assembly 10 to the platen 34 to print upon the paper carried by the platen. The platen is inclined forwardly—that is, toward the right as viewed in FIG. 5—from bottom to top, whereby each successive projectile will bounce angularly downwardly as indicated by the broken lines 40, 42 and 44, 46 to be deflected into a lower projectile passage 48 and to a sump 50 from which they are lifted by a rapidly rotating cyclone 52 to an upper projectile passageway 54 leading to the open top of the bin 38 to maintain an adequate supply of projectiles therein.

A gun driving motor 56 with an output shaft 58 drives a pulley 60 belted by a belt 62 to a pulley 64 fixed to cyclone 52 to constantly rotate the latter for lifting the projectiles as described above. The output shaft also has a pulley conformation 66 which, through a belt 68 and pulley 70, constantly rotates a vertical stub shaft 72 to which is fixed a pinion 74, which meshes with a gear 76 fixed to the driving element 78 of a friction clutch, the driven clutch element of which is identified by reference numeral 80. The driven element 80 is fixed to a shaft 82 upon which the driving clutch element 78 is mounted for rotation. The constantly rotating driving element 78 will frictionally urge the driven element 80 to rotate when clutched thereto. As more fully disclosed in said copending application, Ser. No. 39,372, the driven element 80 is provided with a toothed wheel 84 which may be engaged or disengaged at will by an electromagnetically operated detent lever (not shown)

contained within a clutch control housing 86. When the detent is engaged, the driven element 80 is held against rotation, and when the detent is disengaged, the driven element will rotate with the driving element 78. The toothed wheel 84 is provided with a specifically predetermined number of teeth.

The shaft 82, which rotates only when permitted by the clutch control device 86, carries at its lower end a count wheel 88 provided with a number of apertures 90 equal in number to the number of teeth on wheel 84. In FIG. 5, an aperture 90 is shown between a light source 92 and a photocell 94, the photocell 94 thus serving to count the number of apertures 90 passing this position in each program or subprogram of operation of the gun.

At its upper end, the shaft 82 extends through the bottom wall 96 of projectile bin 38 and has fixed thereto a circular blade 98 having peripheral teeth and similar to a circular saw blade in appearance. The blade 98 lies close to the inner surface of the bottom wall 96 and has a diameter about equal to the dimensions of the bottom wall, whereby the blade covers most of the area of the bottom of bin 38. The blade 98 is made of metal substantially thinner than the diameters of the projectile spheres and is provided with a number of teeth equal to the number of teeth on wheel 84 and the number of apertures in counting wheel 88. As will be explained more fully hereinbelow, the teeth of blade 98 are so spaced and shaped that only a single projectile sphere may be lodged in each inter-tooth space. Since a very large number of projectile spheres is constantly maintained in bin 38, it is assured that a sphere will gravitate into each of the inter-tooth spaces of wheel 98.

A guide block 100 is positioned closely above a portion of blade 98 to deflect the spheres from the inter-tooth spaces and guide them successively into a passageway formed in the bin 38, as is more fully described in said copending application, Ser. No. 39,372. From this passageway, the projectiles are directed into the gun assembly 10 to be discharged toward the platen 34.

The gun assembly 10 is moved in the gimbal mounting to aim the projectiles by a pair of deflector drive systems, only one of which is shown in FIG. 5. The system indicated generally at 102 in FIG. 5 includes a rod 104 extending vertically and terminating in a head 106 which engages a cam 108 on the gun 10. The rod 104 is moved up or down in response to commands from the computer that controls the printer. Such movements of rod 104 serve to move the gun 10 in vertical directions about the horizontal axis of the gimbal mounting. An identical deflector drive system is provided to move the gun 10 in horizontal directions about the vertical axis of the gimbal mounting.

Referring now to FIG. 1, which is greatly enlarged, a segment of saw-like blade 98 and a fragment of the bottom wall 96 of bin 38 are shown, as is a small fragment of the guide block 100. The passageway formed in bin 38 for exit of the projectiles delivered by the blade 98 is identified by the reference numeral 108 and it opens into an outlet guide 100 made of plastic material and having a passageway 112 aligned with passageway 108. The outlet guide 110 is fixed to the projectile supplying station 22 and is generally conical so as to extend into the entrance of gun 10 without interfering with the universal movement of the gimbal-mounted gun 10 about the point 20, which as described above is the point of intersection of the vertical and horizontal axes of the gimbal mounting.

The body 114 of gun 10 is preferably made of metal and is shaped interiorly for convenient assembly of the several gun parts, as is more fully described in said copending application, Ser. No. 39,372. Thus a gun barrel 116, made of plastic material, is fitted into a tapered recess at the left-hand end of body 114 and the breech 24 of the present invention is fitted into an annular recess having an annular shoulder 118 against which the breech 24 is pressed. A loading guide 120, preferably made of steel, is pressed against an annular shoulder 122. A plurality of discrete spacing blocks 124 is provided to separate the loading guide 120 and a plastic seal 126 to provide an annular chamber 128 communicating with a tube 130. The tube 130 is connected with a source of compressed air or other gaseous material. The plastic seal 126, as well as all of the interior gun parts just described, is held in the gun body 114 by a spring ring 132 which snaps into a suitable recess in the right-hand end of the gun body 114.

A designator cam 115, made of plastic material, is fixed to the gun body 114 exteriorly of the barrel 116. The heads, such as head 106 (FIG. 5), of the deflector drive mechanisms bear against cam 115 to effect the controlled universal aiming movements of the gimbal mounted gun 10.

The preferred projectiles for the microballistic printer are spheres made of tungsten carbide, each having a diameter of 0.8 mm. A very large number of such spheres is provided, inasmuch as they are propelled through the gun 10 at cyclic rates as high as 2,000 per second and an adequate supply of projectiles must be maintained at all times within the bin 38. It will be understood that the printing of each letter or other character on the printing medium on platen 34 requires a program of firing of projectiles in one or more subprograms or bursts synchronized with aiming of the gun after each projectile is fired and between each burst which prints an element of the character. Characters such as the numeral "1" may require a program including a single burst or subprogram involving a specific number of projectiles and a single vertical traverse of the gun. The letter "S" may require a program including a single burst of a different predetermined number of projectiles synchronized with a single appropriately curved traverse of the gun. A character such as the letter "T" may require a program involving three subprograms, two with firing of bursts to print the vertical and horizontal elements of that letter, and one for traversing the gun with firing of projectiles between the other two subprograms. The computer, therefore, is programmed for each character to provide gun traversing movements with or without firing of projectiles as may be required and for movement of the paper or other printing medium to provide line-spacing or other movements required between printing of characters. These operations are all more fully described in said copending application, Ser. No. 39,372.

For understanding of the present invention, it is essential only to point out that, for the firing of each burst of projectiles in a program or subprogram, the slip clutch 78, 80 (FIG. 5) is released by the detent mechanism 86 to permit rotation of the saw blade 98 for the period of time required to supply the specific predetermined number of projectiles required for that burst to the gun.

Referring now to FIG. 1, the gun 10 and projectile supplying unit 22 are shown in a condition existing momentarily in an active cycle of firing of a burst of projectiles in a program or subprogram. A projectile 134 is exiting the muzzle 136 of the bore 138 of barrel 116. A projectile 140 has just entered the breech 24. The saw blade 98 is rotating clockwise as viewed in FIG. 1, and a tooth 142 is urging a projectile 144 toward the left within passageway 108. A tooth 146 is moving a succeeding projectile 148 toward the left to displace projectile 144, thereby forcing a continuous line of projectiles 150 to move projectile 140 through the breech 24 for discharge through barrel 116. Since discharge of projectile 140 is effected by gaseous pressure, the breech 24 is so constructed that it forms a seal with each projectile which enters and is forced through the restriction or sphincter of the breech. During the brief period that a projectile thus seals the breech, gaseous pressure builds up behind that projectile in chamber 128 and a subchamber 129 to provide a sufficient volume of pressurized gas to discharge the projectile as soon as it passes the breech restriction.

The breech of the present invention is provided with a resilient restriction and with sealing means which constitute improvements over the corresponding elements of the breech disclosed in said copending application, Ser. No. 39,372.

The breech 24 preferably is constructed as a unit which may be replaced, if required, without need for replacing other components such as the barrel 116, loading guide 120, and seal 126. This is a distinct advantage over the breech disclosed in said copending application, Ser. No. 39,372, wherein the resilient breech restriction is made of a resilient plastic material which must yield to permit passage of a projectile and spring back to shape to act as a seal for the next projectile. While cyclic lives of many millions are available by selection of suitable resilient plastic material for such breeches, the present invention provides a breech wherein metal elements afford the required resiliency and also protect the yieldable material which affords the required sealing function.

Figure 2:
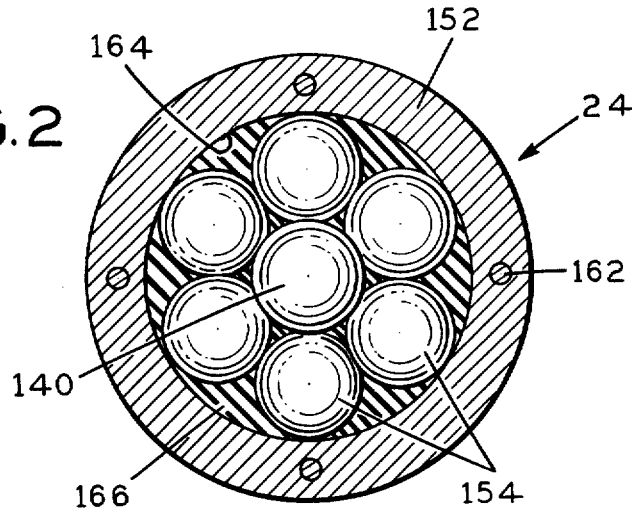
FIG. 2 is a vertical sectional view taken along the line 2—2 of FIG. 1.

Referring to FIGS. 1 and 2, the resilient breech 24 comprises a metal cup 152 with a plurality of metal spheres 154 so positioned in the cup 152 that the innermost points of the surfaces of the spheres define a central opening having a diameter slightly less than the diameters of the spherical projectiles to be forced through the breech 24 when the microballistic printer is in operation. Thus, in FIG. 1, the projectile 140 is shown lodged momentarily against the spheres 154, the center line of sphere 140, indicated by reference numeral 156, being slightly to the right of the common center line 158 of the spheres 154. The spheres 154 are held in a common vertical plane, including the common center line 158, by virtue of the fact that they have been placed in stressed equilibrium, as will be described below. Furthermore, the spheres 154 are closely confined between the bottom wall of cup 152 and a retainer ring 160 held in place as by screws 162. The outer peripheries of the spheres 154 are firmly pressed against the inner wall 164 of the cup 152. As will be apparent from FIGS. 1 and 2, forcing the projectile 150 through the undersized opening defined by spheres 154 can only be accomplished by spreading that opening with consequent temporary distortion of the spheres 154, the cup 152, and the projectile 140 itself at the various points of contact between those elements. By proper selection of the metal or metals from which the projectile 140, spheres 154, and cup 152 are made, and by proper sizing of the parts, such distortion may be limited to extents well within the elastic limits of the parts, whereby all parts spring back into original shapes and dimensions after each successive projectile 140 or 150 is forced through the breech.

For gaseous sealing between the resilient breech 24 and the successive projectiles 140, 150 forced through it, the interstices between spheres 154 are filled with an elastomeric material 166—for example, a synthetic rubber. Preferably, as will be described, the elastomeric material 166 is injection-molded during assembly of the breech 24 in such manner as to leave a central opening to snugly fit against and form a seal with each projectile passing through the breech.

For purposes of illustration, the spheres 154 are shown herein as having the same diameter as that of the projectiles to be used. The projectiles preferably are made of an extremely hard and wear-resistant metal such as tungsten carbide, and the spheres 154 are also preferably made of that same material.

As a matter of convenience, the spheres 154 may constitute a group of the same spheres as the projectiles themselves. In that event, advantage may be taken of the well-known fact that if seven spheres of identical diameter are arranged with one sphere serving as a center and six spheres surrounding it, the seven spheres will form a tight configuration in which all seven spheres are in contact with each other; that is, each of the six surrounding spheres will be in contact at points defining a circle surrounding the central sphere and will be in contact with the central sphere at six equidistant points around the diameter of that central sphere. If, in such a configuration, the diameter of each sphere is identified as (d), the outside diameter of the configuration will be 3(d). In a specific embodiment of the present invention, six spheres of diameter equal to that of the projectile spheres are arranged in the metallic cup 152 which has an inside diameter slightly less than 3(d). For example, when spheres each having a diameter of 0.8 mm. are used and in which event 3(d) would be 2.4 mm., a cup is used having an inside diameter of 2.35 mm.

In the illustrative dimensions given above for use with spheres having a diameter of 0.8 mm. and wherein the inner diameter of the cup within which the six spheres are held in stressed equilibrium is only 0.05 mm. less than 3(d), it will be recognized that the distortion of the individual spheres at points of contact is very small and is well within the elastic limit of the material. The innermost peripheral points of the six spheres 154 thus held in stressed equilibrium will define a circle which is slightly less in diameter than that of an individual sphere. Consequently, if one is to try to force a seventh sphere such as the projectile 140 through this restricted central opening, resistance will be met and the central sphere will remain lodged against further progress until sufficient additional force is applied to the central sphere to temporarily enlarge the effective opening as a result of distortion at the points of contact between the central sphere, the surrounding spheres, and the cup. Immediately that the central sphere or projectile 140 passes the point of maximum resistance, the resiliency of the entire configuration will tend to expel the central sphere beyond the point of greatest restriction.

It will be apparent that while it is preferred to use six spheres 154 identical with the projectiles 140, 150, a smaller number of large spheres or a larger number of smaller spheres may be arranged in a cup of appropriately different inner diameter to define a central opening slightly smaller than the diameter of the projectiles to be used. Such modifications are within the purview of the present invention.

Figure 3:
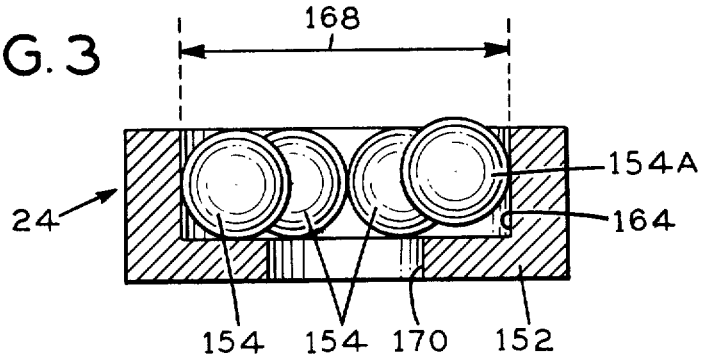
FIG. 3 is a vertical sectional view illustrating a step in the assembly of the improved breech shown in FIG. 2.
Figure 4:
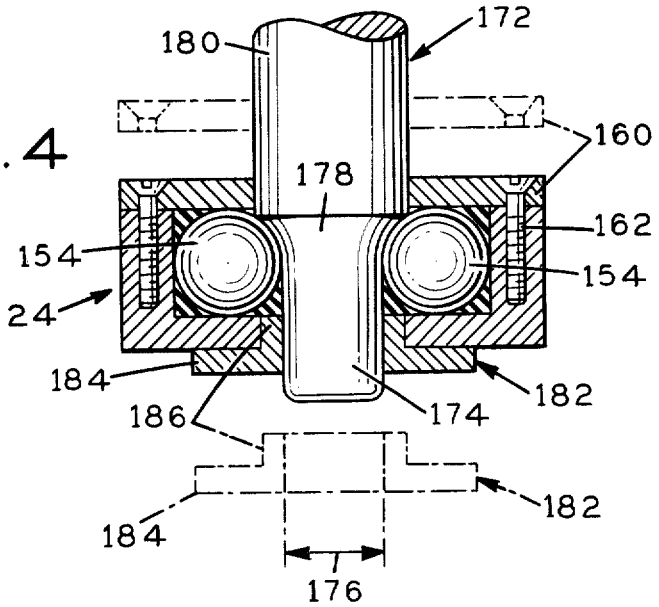
FIG. 4 is a view similar to FIG. 3 but illustrating further steps in the assembly of said breech.

In FIGS. 3 and 4, there is shown a method of assembly of a breech 24 embodying the present invention. In FIG. 3, a cup 152 is shown in section, the inner wall 164 of which has a diameter 168 which is slightly less than three times the diameters of the spheres 154. The cup 152 is provided with an exit opening 170 which has a diameter somewhat greater than the diameter of the projectiles to be used. Assuming that six spheres 154 are to be used, it will be understood that five such spheres will fit loosely in the cup but that the sixth sphere 154A will not fall into a circular arrangement with the others because of the slightly restricted inner diameter of the cup. Illustratively, in FIG. 3, the sixth sphere 154A is shown above the position which it must assume.

In FIG. 4, there is shown a mandrel 172 having a lower end portion 174 of a diameter 176 slightly less than the diameter of the projectiles to be used. The portion 174 is connected by an arcuately curved shoulder 178 with an upper portion 180 having a diameter substantially larger than the projectile diameter. In use, the retainer ring 160 is first moved onto the upper portion 180 of the mandrel and the lower end 174 is then pressed downwardly into the cup 152, leaving the spheres 154 in the arrangement shown in FIG. 3. Continued downward pressure on the mandrel will bring shoulder 178 into contact with the spheres 154 and force them into a common plane and into contact with the bottom wall of cup 152. The retainer ring 160 may now be secured by screws 162 to the upper rim of the cup 152 and the spheres 154 resultantly will be held in stressed equilibrium in the position shown in FIG. 4.

At this juncture, the elastomeric material 166 may be injected to fill the interstices between spheres 154. If so, it may be desirable to provide a molding cap 182 having a flange 184 and a tubular protuberance 186 to cover and to fill the exit opening 170 of cup 152. After the elastomeric material has been injected and cured, the molding cap 182 is removed and the assembled resilient breech 24 is removed from the mandrel 180 ready for use.

Referring again to FIG. 1, when it is desired to replace the breech assembly of this invention, the gun, indicated generally by reference numberal 10, is freed from its gimbals and detached from the air source 130. The spring ring 132 is removed, which will permit the member 126 and the loading guide 120 with its associated spacing blocks 124 to be removed. This will free the breech assembly, indicated generally be reference numeral 24, which may then be replaced with an assembly such as shown in FIG. 2. The gun is reassembled and repositioned in the gimbals and is ready for another extended use.

It will be apparent that minor variations in details of structure will fall within the purview of this invention. For example, the cup 152 has been shown as an integral structure, but it will be apparent that it may be made by assembling a length of cylindrical tubing to constitute the circular wall with a disc with an appropriate central opening to constitute the bottom wall which opposes the disc 160 in final assembly of the breech 24.

While it is preferred to use as resilient elements of the breech 24 spheres such as spheres 154 which are so related in diameter to the inner diameter of the cup 152 as to require forcing them into stressed equilibrium in the final assembly as described above, it is possible to use spheres 154 which will not require forcing in order to define a central projectile receiving opening slightly smaller in diameter than that of the projectiles to be used. For example, spheres 154 of slightly smaller diameter may be placed in circular array in a cup of such diameter that the spheres will fit snugly but without stress along the circle of contact between spheres and will define a projectile receiving opening of desired diameter less than that of the projectiles to be used. In such event, the embedding resilient plastic material 166 will be effective to hold the spheres 154 in place, since there will be no resilient distortion and high friction between unstressed adjacent spheres, as is the case when the spheres are stressed in place as disclosed in the preferred construction.

It will be seen that I have aaccomplished the objects of my invention. I have provided an improved breech for use in a microballistic printer and, more particularly, a breech which is more resistant to wear than are the breeches of the prior art.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. In a breech for use in microballistic printers in which projectiles having a predetermined cross-sectional diameter are successively fired through a gun, said breech comprising a resilient restricted projectile receiving opening of predetermined diameter through which projectiles of larger cross-sectional diameter are to be forced, the combination of a cup comprising a cylindrical wall having a predetermined inner diameter and opposed end walls each having a central opening aligned with said projectile receiving opening, and six spheres each having a diameter greater than one-third of the inner diameter of said cylindrical wall, said six spheres being positioned by forcing into said cup in a circular array under stressed equilibrium in which the innermost points of said spheres define said projectile receiving opening with a diameter less than the diameter of each of said six spheres.

2. In a breech for use in microballistic printers in which projectiles having a predetermined cross-sectional diameter are successively fired through a gun, said breech comprising a resilient restricted projectile receiving opening of predetermined diameter through which projectiles of larger cross-sectional diameter are to be forced, the combination of a plurality of metallic elements, means confining said elements in a circulr array to define said projectile receiving opening, and a resilient plastic material embedding and filling all interstices between said elements to form a gaseous seal surrounding said projectile receiving opening.

3. In a breech for use in microballistic printers in which projectiles having a predetermined cross-sectional diameter are successively fired through a gun, said breech comprising a resilient restricted projectile receiving opening of predetermined diameter through which projectiles of larger cross-sectional diameter are to be forced, the combination of a plurality of metallic spheres, means for confining said spheres in a circular array in which the innermost points of said spheres define said projectile receiving opening, and a resilient plastic material embedding and filling all interstices between said spheres to form a gaseous seal surrounding said projectile receiving opening.

4. In a breech for use in microballistic printers in which projectiles having a predetermined cross-sectional diameter are successively fired through a gun, said breech comprising a resilient restricted projectile receiving opening of predetermined diameter through which projectiles of larger cross-sectional diameter are to be forced, the combination of a cup comprising a cylindrical wall and opposed end walls each having a central opening aligned with said projectile receiving opening, a plurality of spheres confined within said cup in a circular array, the innermost points of said spheres defining said projectile receiving opening, and a resilient plastic material embedding and filling all interstices between said spheres to form a gaseous seal surrounding said projectile receiving opening.

5. In a breech for use in microballistic printers in which projectiles having a predetermined cross-sectional diameter are successively fired through a gun, said breech comprising a resilient restricted projectile receiving opening of predetermined diameter through which projectiles of larger cross-sectional diameter are to be forced, the combination of a cup comprising a cylindrical wall having a predetermined inner diameter and opposed end walls each having a central opening aligned with said projectile receiving opening, six spheres each having a diameter greater than one-third of the inner diameter of said cylindrical wall, said six spheres being positioned by forcing into said cup in a circular array under stressed equilibrium in which the innermost points of said spheres define said projectile receiving opening with a diameter less than the diameter of each of said six spheres, and a resilient plastic material embedding and filling all interstices between said spheres to form a gaseous seal surrounding said projectile receiving opening.

* * * * *